US005203599A

United States Patent [19]

Lewis et al.

[11] Patent Number: 5,203,599

[45] Date of Patent: Apr. 20, 1993

[54] GRAPNEL FOR UNDERWATER CABLE

[75] Inventors: Martin Lewis; Paul Davis; Mark V. Batten, all of Hants, England

[73] Assignee: British Telecommunications public limited company, London, England

[21] Appl. No.: 725,811

[22] Filed: Jul. 8, 1991

[30] Foreign Application Priority Data

Apr. 17, 1991 [GB] United Kingdom ..... 9108240

[51] Int. Cl.[5] ..... B63G 7/20

[52] U.S. Cl. ..... 294/66.1; 405/158

[58] Field of Search ..... 294/66.1; 405/158, 173

[56] References Cited

U.S. PATENT DOCUMENTS

| | | | |
|---|---|---|---|
| 3,129,030 | 4/1964 | Brockbank et al. | 294/66.1 |
| 3,319,426 | 5/1967 | Slonczewski | 294/66.1 X |
| 3,990,255 | 11/1976 | Cosier et al. | 294/66.1 X |
| 4,768,820 | 9/1988 | Barone | 294/66.1 |
| 4,805,547 | 2/1989 | Matsuzaki et al. | 294/66.1 X |

FOREIGN PATENT DOCUMENTS

| | | | |
|---|---|---|---|
| 1492988 | 11/1977 | United Kingdom . | |
| 1540724 | 2/1979 | United Kingdom | 294/66.1 |

*Primary Examiner*—Dennis H. Pedder
*Assistant Examiner*—Joseph D. Pape
*Attorney, Agent, or Firm*—Nixon & Vanderhye

[57] ABSTRACT

A grapnel for recovering telecommunications cables from deep oceans has special features for treating the cable gently, cutting the cable and holding a predetermined side of it. The grapnel includes a rotor which is adapted for rotation about a longitudinal axis of the grapnel. The rotor is located between two cutting stations and is preset for rotation in either the clockwise or the anti-clockwise direction. In operation, the rotor acquires one run of cable from below and this run of cable is held clear of both cutting stations. The rotor acquires the other run of cable from above, and this run of cable is introduced into one of the cutting stations. After winding, both cutting stations are actuated, and a predetermined run is cut. The other predetermined run is held because it is wound round the rotor and it can be retrieved to the surface. The direction of rotation of the rotor determines which end is cut and which end is held, and the direction of the rotation remains the same even if the grapnel deploys upside-down.

10 Claims, 6 Drawing Sheets

Fig. 3.
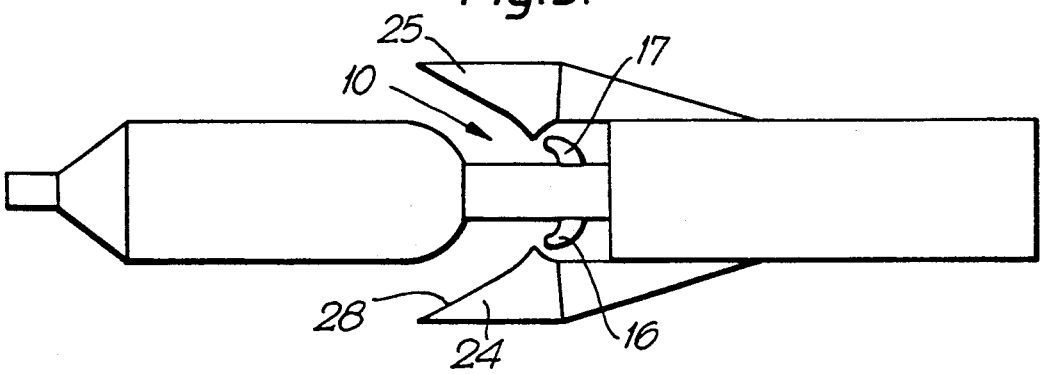
Fig. 4. a
(anti-clockwise)
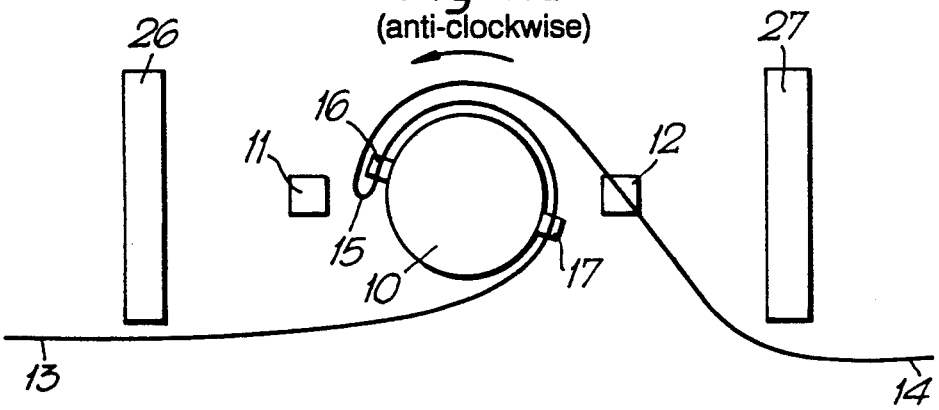
Fig. 4. b
(clockwise)
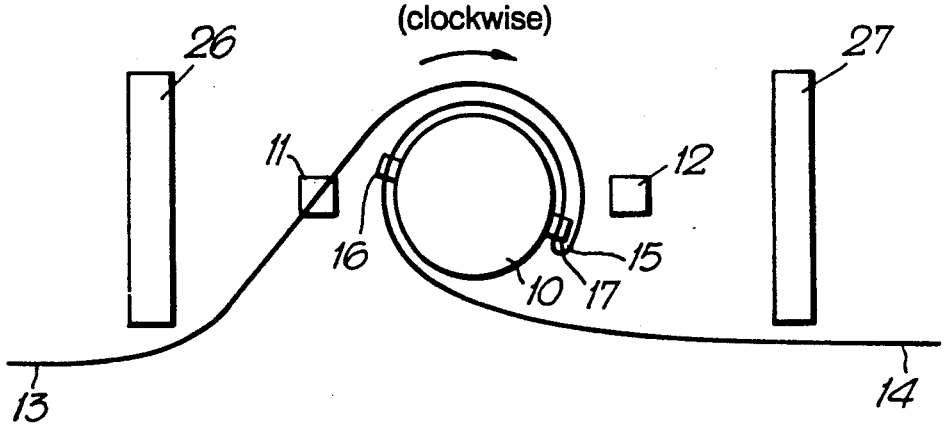

GRAPNEL FOR UNDERWATER CABLE

This invention relates to a grapnel, and in particular it relates to a grapnel which is adapted to recover telecommunications cables which have been laid in the deep oceans.

Intercontinental telecommunications cables have been in use for many years, and it is apparent that these cables must traverse even the deepest parts of the oceans. While it is intended that such cables shall never be recovered accidents may occur and the cable may fail. In such circumstances it may be economic to retrieve the cable in order to repair it. Such recoveries may be needed even from the deep oceans, and it has already been established that grapnels may be used to effect the recovery. Recently telecommunications cables, and especially deep ocean telecommunications cables, can have a much smaller cross sectional area. It has turned out that the grapnels previously designed for the recovery of the older and thicker cables may inflict unnecessary damage on the more modern cables. Thus it became necessary to re-design the grapnels, so that the recovered cable is treated more gently.

Certain operational requirements are common to all grapnels which are used to recover cables from the sea bed. First, the depth of the sea means that the length of the cable is insufficient for it to be brought to the surface. This is particularly true for cables laid in the deepest oceans. Since the cable cannot be brought to the surface intact, it is necessary to cut the cable and then bring the cut end to the surface. In many operations it is required to cut the cable and then bring a selected end to the surface. It is clearly desirable to combine all of these functions into a single marine operation, and this requires a grapnel which is capable of acquiring a cable, cutting the cable, holding a preselected end of the cable, and bringing that preselected end to the surface.

There is a particular operational difficulty in the requirement to hold a preselected end. This arises because the grapnel can rotate about its tow rope as it is lowered to the sea bed. This means that it is impossible to control the orientation of the grapnel when it arrives at the sea bed. A grapnel usually has a flat elongated shape, and it will lie flat on the bottom of the sea. However it is not possible to control which surface is up and which surface is down. More importantly it is not possible to predetermine which side will be "right" and which side will be "left." Thus, although it is necessary that the grapnel should cut on a predetermined side, the orientational ambiguity means that it is difficult to preselect.

It is an object of this invention to provide a grapnel which will cut and hold a cable on a preselected side, and to treat the cable gently while it achieves this operation.

According to the invention, the cable is acquired by a rotor which is adapted for rotation about an axis substantially parallel to the direction in which the grapnel is towed. The rotor is located between two cutting stations. The rotor is preset for rotation in either the anti-clockwise or clockwise direction, and the direction of rotation determines which side of the cable is cut. It will be appreciated that the arbitrary orientation selected by the grapnel does not affect the direction of rotation of the rotor and, therefore, the orientation of the grapnel does not affect which side it is out. The operation of the will be described in greater detail below.

The operation of the cut-and-hold feature of the grapnel is preferably initiated by two triggers which are located one at each side of the grapnel. These triggers are actuated by the acquisition of the cable and both triggers must be actuated in order to initiate the sequence. As will be explained in greater detail below, this feature helps to ensure that the cable is properly acquired before the out-and-hold sequence is initiated, and it also helps to reduce the incidence of unwanted initiations.

The invention will now be described by way of example with reference to the accompanying drawings in which:

FIG. 3 is a diagrammatic side view of the grapnel;

Figure 2:
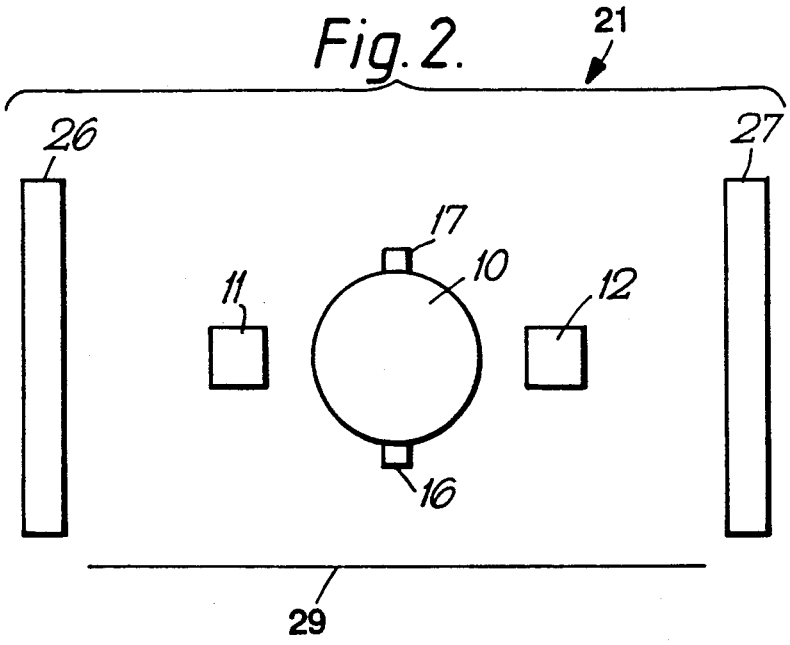
FIG. 2 shows the relative positions of important components of a preferred embodiment of the grapnel.
Figure 5:
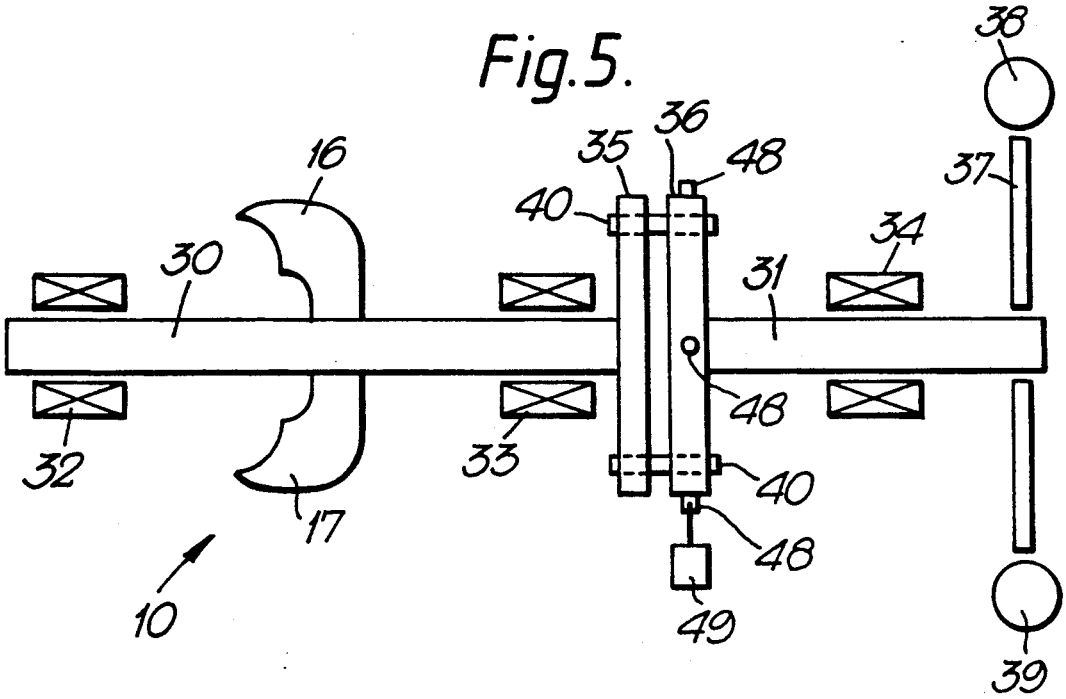
Figure 7:
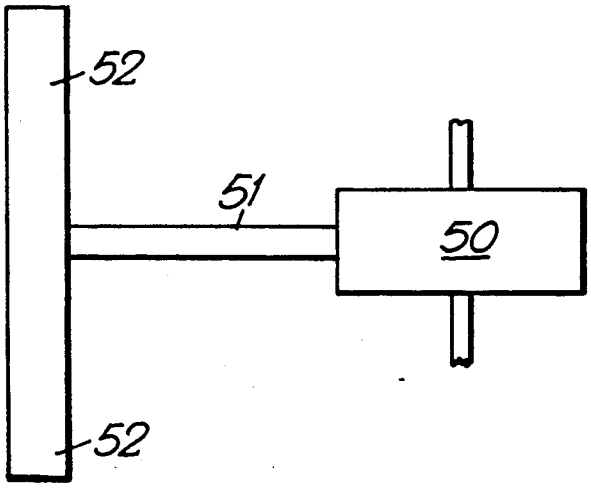
Figure 6:
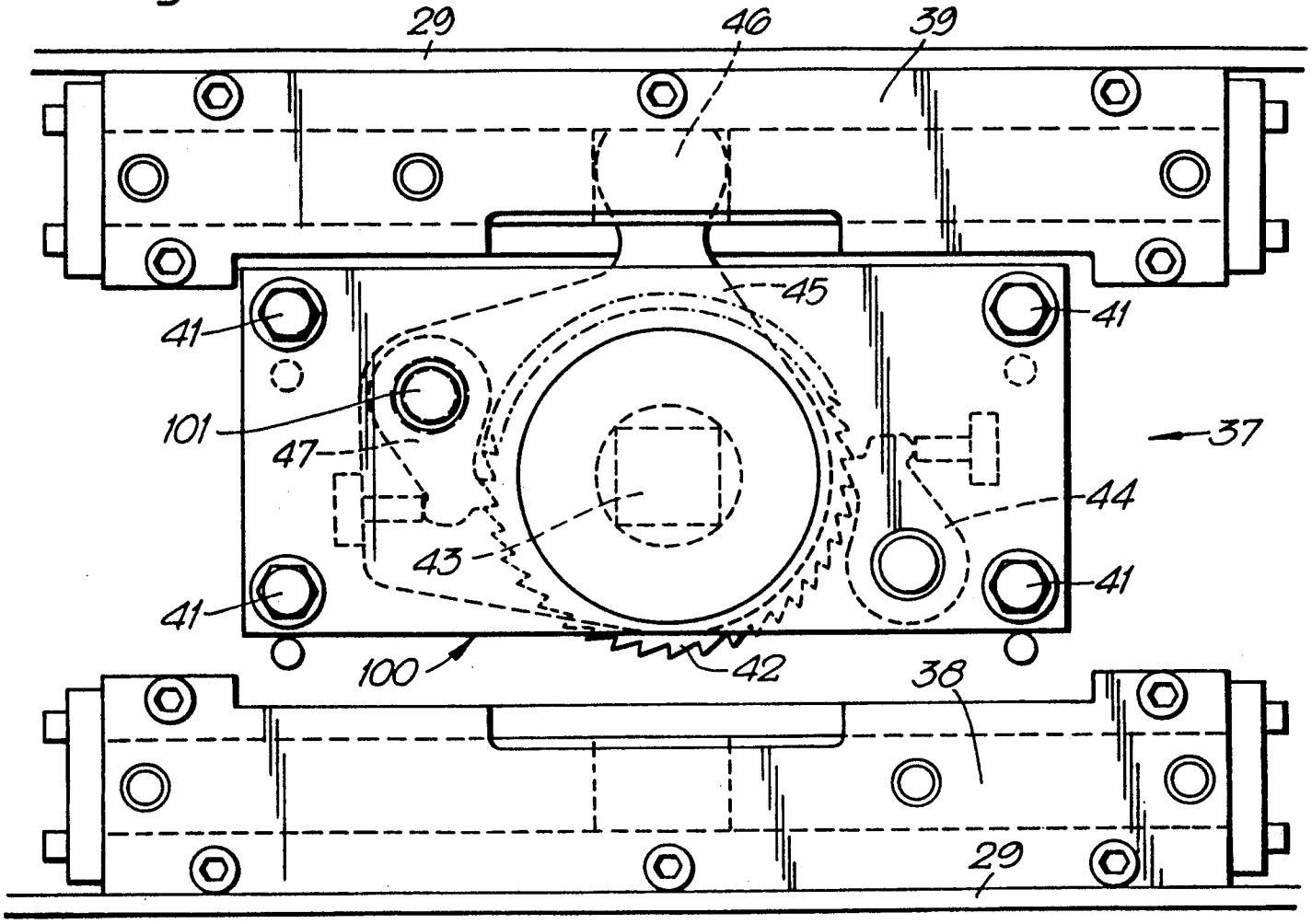
Figure 8A:
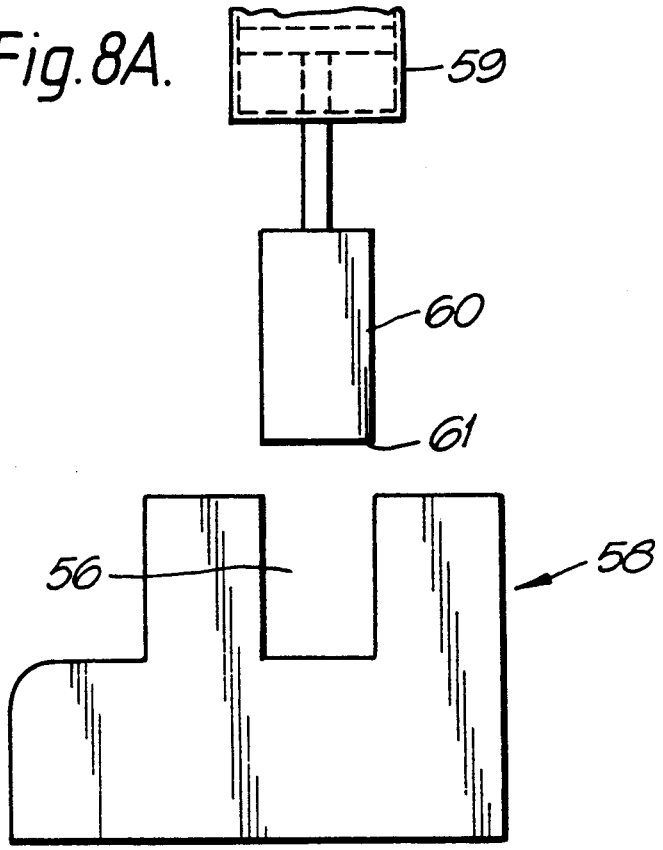
Figure 8B:
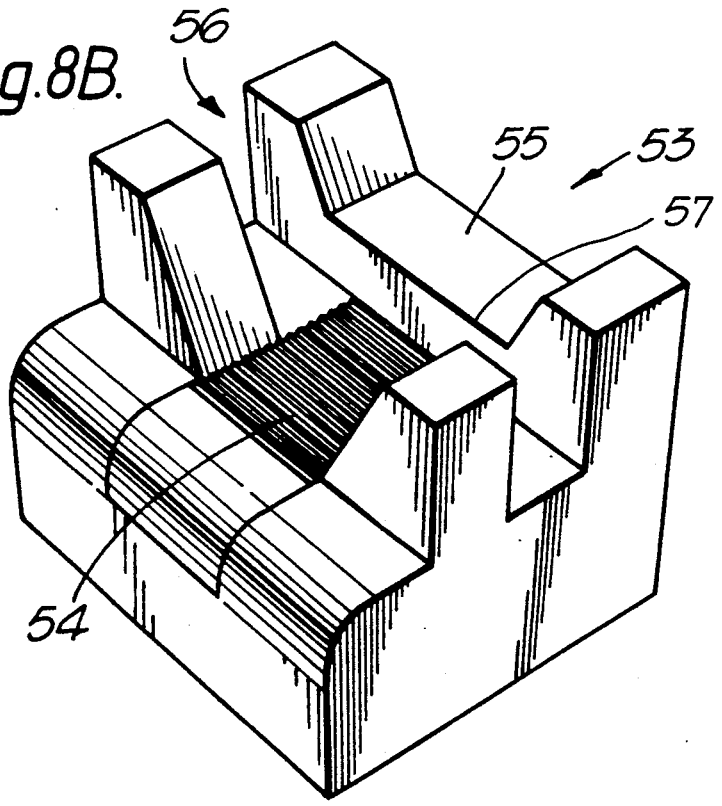
Figure 9:
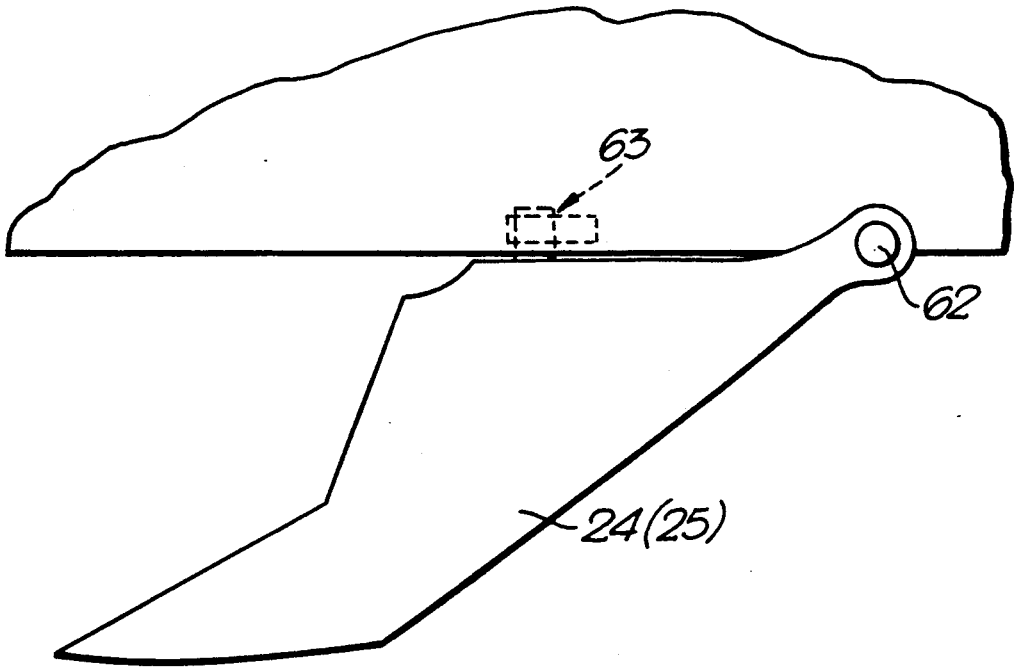

FIGS. 4*a* and 4*b* comprise two diagrams labelled "Anti-clockwise" and "clockwise", and illustrates the two operational modes needed to select one of two cable runs;

FIG. 5 is a diagrammatic illustration of a preferred embodiment of the rotor shown in FIGS. 2, 3 and 4;

FIG. 6 is a diagram which illustrates, in greater detail, the drive mechanism shown in FIG. 5;

FIG. 7 is a diagrammatic illustration of the trigger means shown in FIGS. 2 and 3;

FIGS. 8A and 8B are diagrammatic illustrations of a cutting station shown in FIGS. 2 and 3; and FIG. 9 illustrates the fixing of the flukes shown in FIGS. 2 and 3.

The purpose of the grapnel is to recover a telecommunications cable from the sea bed. In most cases, there is not enough slack in the cable to permit a segment of the cable to be brought to the surface. It is, therefore, necessary to cut the cable, and to bring only one end to the surface. It is highly desirable to select which end is recovered. The general principles which enable this to be achieved will now be described.

Figure 1:
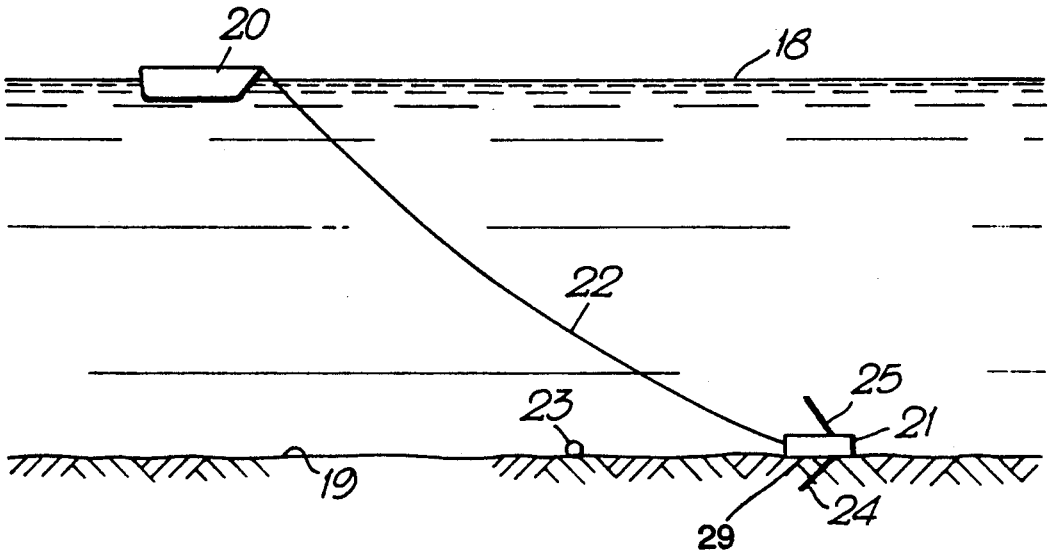
FIG. 1 illustrates the use of the grapnel.

FIG. 1 shows a grapnel 21 towed behind a ship 20, to bring a cable 23 lying on the sea bed 19 to the sea surface 18.

It will be assumed that the depth is about 6 km, but the grapnel can be used at whatever depth submarine cables are laid. (In very shallow water, e.g. depth below 100 m, techniques more convenient than a grapnel would probably be available). As FIG. 1 suggests the recovery operation commences to a selected side of the cable 23. If the position of cable 23 is uncertain, then a generous allowance should be made. The grapnel 21 is lowered to the sea bed 19 by a tow rope 22, and it is towed towards the cable 23. Preferably the towing direction is at right-angles to the presumed run of cable 23. The grapnel 21 has two flukes 24 and 25, which project from the upper and lower surfaces of the grapnel as deployed.

It should be realised that it is inconvenient to control the grapnel to deploy with the correct side uppermost and, therefore, it is constructed symmetrically so that the top and bottom are the same. This means that it does not matter if the grapnel happens to deploy "upside down." As shown, fluke 24 is the lower and, therefore, fluke 24 projects into the sea bed and it is drawn along the sea bed as the grapnel is towed. If the grapnel were to deploy in the alternate orientation fluke 25 would project into the sea bed. Eventually, the grapnel 21 is towed across the cable 23. Most of the grapnel 21 passes above the cable 23 but the fluke 24 passes underneath the cable and, therefore, the cable 23 is drawn into and acquired by the grapnel 21.

As shown in FIG. 2, the basic mechanism of the grapnel 21 comprises a hydraulically driven rotor 10 which is located symmetrically between two cutting stations 11 and 12. The cutting stations 11 and 12 are located symmetrically between two trigger means 26 and 27. The rotor 10 includes radially projecting horns 16 and 17 which are located diametrically opposite one another. Each of the horns 16 and 17 curves towards the forward end of the grapnel 21 to assist in the acquisition of a cable. (Preferred embodiments of various components of the grapnel will be described in greater detail below.)

As it is first acquired, the cable 23 passes below the rotor 10 but it engages each of the triggers 26 and 27. It should be noted that the triggers 26 and 27 extend both above and below the rotor 10 so that, when the rotor deploys in the alternate orientation, the cable 23 still engages with both of the triggers 26 and 27. This engagement releases the power stored in the grapnel to cause rotor 10 to rotate. The operation will be described in greater detail below, with reference to FIG. 4.

FIG. 3 is a side view of the grapnel as it is deployed. During its preparation for deployment, the rotor 10 is adjusted so that its horns 16 and 17 are vertical. FIG. 3 is a side view of the grapnel, showing the horns in this position.

When being towed as shown in FIG. 2, the bearing surface 29 of the grapnel 21 rests on the sea bed, and lower fluke 25 projects downwardly from the bearing surface 29. When the Grapnel 21 crosses the cable, the guide edge 28 of the fluke 24 engages with the cable, and the motion of the grapnel lifts the cable into contact with the rotor 10, so that the cable is engaged by the horn 16. It should be noted that the horns 16 and 17 are shaped to cooperate with the flukes 24 and 25. It will be appreciated that this feature increases the reliability of the grapnel because the relative shapings of the flukes and the horns are such that the cable is guided off the guide edge 28 of the fluke 25 into the horn 16.

FIG. 2 shows that there are two trigger means 26 and 27 which are located one on each side of the grapnel. Therefore, when a cable is acquired as described above, it is brought into contact with both triggers 26 and 27, and when both triggers are actuated the capture sequence is initiated. It is emphasized that the two triggers 26 and 27 are in series so that both must be actuated to initiate the process. Two reasons for the use of two triggers will now be explained:

It has already been mentioned that it is desirable that the recovery operation should be conducted by towing the grapnel at right-angles to the anticipated run of the cable 23. However the orientation of the cable is not known for certain, and particular segments of the cable may lie at an angle to the general direction. Therefore, the grapnel may not cross the cable at exactly a right-angle. When this happens, it is possible that the cable will engage one side of the grapnel before the other. However, to achieve greatest reliability in operation, it is desirable that the initiation of the mechanism should be delayed until both sides of the cable have been acquired. Providing two triggers, one at each side, and delaying the initiation until both are actuated provides more reliable operation, in that it helps to ensure that the cable is fully acquired before the operation is initiated.

It is also possible that the triggers may be actuated inadvertently, e.g. by rocks or other debris which may be in the sea. The probability of accidental and unwanted actuation of two triggers simultaneously is clearly much smaller than the possibility of the actuation of one trigger by itself. Therefore the provision of two trigger means 26 and 27 reduces the incidence of unwanted actuation. It should be emphasized that the grapnel is only capable of one cycle of operations after each deployment and, therefore, accidental actuation would require a re-run of all the whole operational sequence. Thus, reducing the incidence of accidental actuations is a considerable advantage.

The basic operation of the grapnel described with reference to FIGS. 1, 2, and 3 will now be described with reference to FIGS. 4*a* and 4*b*. It should be remembered that the fundamental objective of the operation is to cut a cable on a pre-selected side, and to bring the other side to the surface. FIGS. 4*a* and 4*b* illustrate the two operational modes which are necessary to achieve this selection. FIG. 4*a* and 4*b* take the form of two diagrams so that there is one diagram for each of the two operational modes. The two diagrams are labelled "anti-clockwise" and "clockwise".

When trigger means 26 and 27 have been actuated as described above, the rotor 10 rotates and one of the horns 16 or 17 will engage with the cable 23 to create a bight 15, which is wound round the rotor in its direction of, rotation. The cable 23 has runs 13 and 14 which extend on opposite sides of the grapnel.

In the upper diagram, the rotor rotates in the anti-clockwise direction, and the run 13 is acquired from below. The rotation carries it to the right hand side of the rotor 10 and then over the top. This means that the run 13 is carried to a low configuration so that it does not engage with the cutting station 11. Neither does it engage with the cutting station 12 because the cable passes between the cutting station 12 and the rotor 10.

The run 14 is acquired by the top of the rotor, and the rotation lifts the run 14 from the sea bed and into engagement with the cutting station 12. When sufficient cable has been wound (usually about 1 ¼ turns) both cutting stations are actuated. This means that the run 14 is severed and the run 13 is held so that it can be brought to the surface. In a preferred embodiment, to be described further below, the cutting station not only cuts but it holds the inboard end of cable so that retention by the rotor 10 is improved.

FIG. 4*b* shows what happens when the rotor 10 moves in a clockwise direction. In this case, it is the run 14 which is held low and away from the cutting station and 12 whereas the run 13 is carried into the cutting station 11. When both cutters are actuated, it is run 14 which is held by the rotor, and, therefore, run 14 is brought to the surface. Thus the direction of rotation of the rotor decides which of the two runs 13 or 14 is recovered.

It is important to realize that when a grapnel is deployed it is not possible to control which way up it lands on the sea bed. It is therefore important to consider what effect inversion will have upon the operations illustrated in FIGS. 4*a* and 4*b*. The important fact is that inverting the grapnel does not change the direction of rotation of the rotor 10. In other words, if, before deployment, the rotor 10 is preset for anti-clockwise rotation, the rotor will rotate in the anti-clockwise direction whichever way up the grapnel lands. Similarly, the rotor 10 can be preset for clockwise rotation, and it will rotate in a clockwise direction whichever way up the grapnel lands. However, inversion of the grapnel interchanges the relative positions of the two cutting stations 11 and 12. If the grapnel lands in the inverted position, cutting station 12 will be on the same side as run 13 and cutting station 11 will be on the same side as run 14. However, anti-clockwise rotation of the rotor ensures that run 14 will engage with cutting station Similarly, clockwise rotation of the rotor ensures that run 13 will engage with cutting station 12 when the grapnel is upside down. When the grapnel is deployed, it is not known whether the selected run will engage with cutting station 11 or 12 and it is, therefore, necessary to actuate both cutting stations. However, the cable always engages on the preselected side, and actuating both cutting stations cuts the pre-selected run of cable. Thus FIGS. 4*a* and 4*b* illustrate the fundamental configuration of a grapnel according to the invention, and also illustrates how this fundamental configuration achieves the object of the invention in cutting the cable at the pre-determined side.

A preferred embodiment of the rotor, identified by the numeral 10 in previous figures, is illustrated diagrammatically in FIG. 5. In the preferred embodiment the rotor comprises two portions, namely a forward portion 30, and rearward portion 31. The forward portion 30 includes the horns 16 and 17, and it is supported by bearings 32 and 33. There is a drive plate 35 at the rear. The rearward portion 3 is supported in a bearing 34 and it has a drive plate 36 located at its forward end. The rotor 10 is driven from its rearmost end by means of hydraulic cylinders 38 and 39 which extend from side to side across the grapnel. Power is transmitted from the hydraulic cylinders 38 and 39 to the rearward portion 31 by means of a ratchet plate 37. The drive mechanism 37, 38 and 39 will be described in greater detail with reference to FIG. 6. However, it should be noted that the drive mechanism includes a ratchet which prevents rotation in the non-selected direction at all times. The forward portion 30 is connected to the rearward portion 3 by means of shear-pins 40.

Most of the features illustrated in FIG. 5 are self-explanatory, but it is considered that two aspects deserve a special mention. The recovered end of the cable is held by the winding of a bight around the forward portion 30 of the rotor. This has been explained above, and it has been stated that one and a quarter turns are ideal. The retention of the pre-selected end demands that the rotor 10 is not allowed to unwind after the cable has been secured. This is achieved by the ratchet mechanism in ratchet plate 37 which prevents rotation of the rotor 10 in the un-winding direction at all times. However, there are certain emergency circumstances in which it is appropriate to dump the cable. Such an emergency circumstance would occur, for example, if the cable were held under a wreck or if it were to foul any obstruction which might be located in the ocean. If the cable were to snag as indicated, the forces would rise until either the cable 23 or the tow rope 22 broke. Both of these would be undesirable, and breaking the tow rope would result in the loss of the grapnel. The shearpins 40, which connect the plates 35 and 36, are provided to safeguard against these undesired occurrences. The shear-pins have a controlled yield value, and they will shear if the yield value is exceeded. Before the grapnel is deployed, a suitable yield value is selected, and shear-pins having the selected value are fitted to connect the plates 35 and 36. The yield value is selected to protect the weaker of the tow rope 22 and the cable 23. In the case of a snag, the loading on the shear-pins 40 increases above the yield value, and the shear-pins 40 break so that the forward portion 30 of the rotor is released, and it is free to rotate. This allows the cable to unwind, so that the end is dumped. It will be appreciated that the provision of shear-pins 40 constitutes a desirable safety feature in the design of the grapnel.

The rear drive plate 36 is provided with four peripheral pins 48, which project from its circumference. The four pins 48 are arranged at 90° spacings around the periphery. A counter 49 is located adjacent to the drive plate 36, so that, as the plate rotates, the pins 48 actuate the counter 49. Thus the counter 49 measures the amount of rotation in units of 90°. The counter 49 is preset to a desired figure and when it has counted as the desired figure it actuates hydraulic valves (not shown) to control the mechanism. Specifically, the valves stop the drive mechanism 37, 38 and 39 and they actuate the cutting stations 11 and 12. The counter 49 controls the amount of cable which is wound up, and counting 5 right-angles provides for the acquisition of 1 ¼ turns (e.g., between 360° and 720°, preferably between 400° and 500°).

The drive mechanism indicated by numerals 37, 38 and 39 in FIG. 5 is shown in greater detail in FIG. 6. FIG. 6 is orientated at right-angles to the shaft of rotor 10, in order that more detail of the mechanism can be illustrated.

The drive mechanism, as mentioned in FIG. 5, comprises hydraulic cylinders 38 and 39 which transfers power through the ratchet mechanism 37. The hydraulic system is not shown in FIG. 6, but the two cylinders are inter-connected in a conventional hydraulic circuit, whereby each acts as the control of the other. This circuit ensures that when hydraulic power is provided, i.e. when the trigger means 26 and 27 have been actuated, each of the two cylinders oscillate. Since there are two cylinders each with two strokes the arrangement can be considered as a four stroke cycle. Any one of the four strokes can be used to provide power but all four strokes contribute to the control function. As already explained, each of the two cylinders 38 and 39 extend from side to side of the grapnel, and they are located towards the rear thereof.

The drive mechanism comprises a base plate 100 which is attached to the rest of the grapnel by bolts 41. A ratchet wheel 42 is rotatably mounted on the base plate 100. The ratchet wheel has a central square aperture 43, which engages with a square stub on the rear end of the rotor 10. This arrangement means that the rotor 10 and the ratchet wheel 42 rotate as a single unit. A pawl 44 is located on the base plate 100, and it engages with the ratchet wheel 42 to prevent rotation in the undesired direction. As shown in FIG. 6, the pawl 44 allows the ratchet wheel 42 to rotate in the anti-clockwise direction, but it prevents rotation in the clockwise direction.

A rocker plate 45 is attached to the pawl 47 by means of a pivot 101. The rocker plate 45 has an arm 46 which engages with the piston in cylinder 39. This means that when the mechanism of cylinder 39 operates, the rocker plate is rotated to and from about the axis of the ratchet wheel 42 and rotor 10. The oscillation of the rocker plate 45 causes the second pawl 47 to oscillate. When arm 46 moves to the left, the pawl 44 advances one tooth around the ratchet wheel 42; pawl 44 ensures that there will be no rotation in the clockwise direction. Movement of the arm 46 to the left constitutes the power stroke of the device. Pawl 47 is engaged with a tooth of the ratchet wheel 42 and the wheel is driven round through the angle of one tooth. Since the wheel is rotating in the anti-clockwise direction, this is permitted by pawl 44.

It will be appreciated that the mechanism just described provides for the rotation of the ratchet wheel, and hence the rotor 10, in a predetermined direction to pick up the cable as described above. When the power is terminated, the pawl 44 resists the rotation of the rotor so that the cable remains held (unless the sheer-pins 40 rupture, as described above).

During the preparation of the grapnel for deployment, the nuts 41 are removed, and the ratchet mechanism taken out. This allows the rotor 10 to be moved freely, so that the horns 16 and 17 can be placed into alignment with the flukes 24 and 25. In addition, the counter mechanism 49 can be zeroed. Furthermore, if the plate is turned round, e.g. so that the ratchet wheel 42 faces forward instead of aft, the selected direction of rotation is reversed. Thus the mechanism described, provides a simple arrangement for preselecting clockwise or anti-clockwise rotation of the rotor in order to select which run of cable is acquired.

FIG. 7 shows a trigger means, represented as 26 or 27 in FIGS. 2 and 4. The trigger means comprises a valve 50 which, when actuated, allows the passage of hydraulic fluid to the cylinders 38 and 39. The valve 50 has an actuating stem 51 with a pressure plate 52, which extends above and below the center plane of the grapnel (in both operational orientations). From whichever side the cable 23 is acquired, it will come into contact with the pressure plate 52, and the pressure will be transferred, via the stem 51, to the valve 50. As has already been explained, the grapnel comprises two trigger means 26 and 27 which are located one at each side of the grapnel. When a cable 23 is fully acquired, it engages with both pressure plates 52 so that both valves 50 are actuated. The two valves 50 are connected in series so that it is necessary to actuate both valves before the motor mechanism 37, 38 and 39 is actuated. This feature has been further described above.

FIG. 8A is a diagrammatic illustration of a cutting station. The grapnel comprises two cutting stations which are numbered as 11 and 12 in FIGS. 2 and 4. Since both cutting stations are the same, only one needs to be illustrated.

The cutting station, as is most clearly seen in FIG. 8A, comprises an anvil 58 which is mounted on the rear portion of the grapnel, and a cutting blade 60 which is mounted on the forward part of the grapnel. The anvil 58 will be described first, with respect to FIG. 8B.

The anvil comprises a cable slot 53 which is mounted substantially horizontally on the grapnel. When a cable is acquired, as described with reference to FIGS. **4*a* and 4*b*, the run selected for cutting is introduced into the cable slot 53 by the rotor 10. The cable slot 53 has a gripping section 54, and a cutting section 55; the cutting section 55 is mounted towards the outboard side of the grapnel. The cutting section 55 stands above the gripping section 54 to form a step which should be at least equal to the diameter of the cable to be cut. The anvil 58 also comprises a blade slot 56 which extends at right angles to the cable slot 53. The inboard edge of the cutting section 55 forms a cutting edge 57**.

The cutting blade 60 is mounted on a hydraulic cylinder 59. The supply of hydraulic fluid to the cylinder 59 is controlled by the counter 49 which is shown in FIG. 5 of the drawings. This arrangement has the effect that the hydraulic cylinder 59 is actuated when the rotor 10 has completed the winding process. The cutting blade 60 is mounted so that, when advanced by the cylinder 59, it engages into the slot 56 of the anvil 58. The cutting blade 60 has a cutting edge 61 facing outwardly on the grapnel. When the cutting blade 60 is advanced, the cutting edge 61 engages with the cutting edge 57 to sever the cable. However the cylinder continues to advance so that the inboard end of the cable is held between the blade 60 and the gripping section 54.

The operation and function of the cutting section will now be described. When the counter 49 has counted the correct rotation of the rotor 10, it opens valves to provide hydraulic pressure to the cylinder 59. This causes the cutting blade 60 to advance towards a cable 23 located in the cable slot 53. As the blade 60 advances into the blade slot 56, the edges 61 and 57 co-operate, as in a pair of scissors or a pair of shears, to out the cable. The inboard end of the cable is located between the advancing cutting blade 60 and the cable gripping section 54, and it is held between these with the pressure applied by the hydraulic fluid in the cylinder 59. The load imposed on the grapnel by the cable 23 is taken by the rotor 10, and the cable is held by the winding round the rotor. However the cable is springy, and there is a possibility that the cable would unwind itself from the rotor, and such unwinding would enable the cable to elope from the grapnel. Holding the out end of the cable between the blade 60 and the gripping section 54 prevents this unwinding, so that the cable remains held by its engagement with the rotor 10. It is emphasized that the cable is held by the rotor, and gripping by the cutting station merely assists the rotor.

The method of attaching the flukes 24 and 25 to the body of the grapnel is illustrated in FIG. 9. Each fluke 24 (or 25) is attached, at its after-end to the body of the grapnel via a pivot 62, and it is held in the operational position by shearing means 63. Conveniently, this attachment is constituted by an inwardly extending plate with two shear pins, one on each side of the fluke, fixing into the body of the grapnel. This arrangement is considered desirable in case the fluke runs foul of some obstacle on the sea bed, e.g. a rock or other debris. This almost always requires the recovery procedure to be aborted. In order to reduce the risk of damage when the operation is so aborted, shearing means 63 fractures if an unsafe load is reached, and the fluke folds back about pivot 62 so that the obstacle is released. It will be appreciated that this feature can save damage to the grapnel and, in extreme cases, breaking of the tow rope with total loss of the grapnel.

Such an emergency is apparent at the ship 20 because the fouling of an obstacle causes a severe increase in the tension of the tow rope, and this tension should always be monitored. When the shear means 63 fractures, the unacceptably high tension suddenly reduces to a low value, and this provides a noticeable sequence of events that the Grapnel has encountered an obstacle. It would be appreciated that a similar increase of tow rope tension to an unacceptable value followed by a sudden release will also be observed during the lifting of a cable should an emergency cause the shear-pins 40 to rupture.

An extra feature, not shown in any drawing, which is preferably incorporated into the grapnel will now be described. As explained above, most emergency events are signalled to the ship 20 by variations in the tension of the tow rope, and monitoring this tension is therefore a desirable operation. However the acquisition of a cable 23 does not cause any noticeable variations in the tension in the tow rope 22 and it is clearly desirable to inform the ship 20 when the cable has been acquired. Therefore the grapnel preferably includes ultrasonic signalling means, which is adapted to emit a characteristic signal when the cable 23 is acquired. Conveniently, the counter 49 as well as providing hydraulic power to the cutting stations, is connected to the ultrasonic signalling means to initiate the transmission of a signal when the cutters are actuated. It will be appreciated that this informs the ship 20 that a cable has been acquired and the receipt of such a signal indicates that towing operations should stop and recovery operations should commence.

As mentioned above, the grapnel includes a hydraulic system, but as is usual for deep sea equipment, the primary source of power is a compressed gas, e.g. nitrogen. In order to isolate the grapnel from its ambient pressure, the hydraulic liquid passes from a high pressure reservoir to a low pressure chamber. The high pressure reservoir contains a gas under high pressure to drive the hydraulic liquid through the system. Pressuring the high pressure reservoir is one of the tasks needed to prepare the grapnel for deployment.

We claim:

1. A grapnel for recovering cables from the sea bed, which grapnel is adapted for towing along the sea bed in a direction substantially parallel to a longitudinal axis of the grapnel, wherein said grapnel includes:

(a) two cutting stations, each of which is capable of severing a cable, and (b) a rotor located between the two cutting stations and having its axis of rotation substantially parallel to the longitudinal axis of the grapnel;

wherein said rotor is adapted to acquire and wind a cable around itself and to cause a first run of cable lying to a first side of the grapnel to be acquired at a low level and held away from said cutting station while also to cause a second run of cable lying to a second side of said grapnel to be acquired at a high level and held into one of said cutting locations whereby actuating both cutting stations severs said second run of cable leaving said first run of cable held by the grapnel for recovery to the surface of the sea.

2. A grapnel according to claim 1, which includes two triggers for initiating the rotation of the rotor, said two triggers being located one at each side of the grapnel and interconnected to require both triggers to be actuated before said rotation.

3. A grapnel according to claim 1, wherein each of the cutting stations is adapted to hold one cut end of the cable whereby the retention of the cable by the grapnel is improved.

4. A grapnel according to claim 1, wherein the cutting operation is triggered after rotation of the rotor through a predetermined angle whereby the cable is cut when a predetermined length has been wound around the rotor.

5. A grapnel according to claim 4, wherein the predetermined angle of rotation is between 360° and 720°.

6. A grapnel according to claim 5, wherein the predetermined angle is between 400°-500°.

7. A grapnel according to claim 1, wherein the grapnel includes projecting flukes to assist in the acquisition of a cable.

8. A grapnel according to claim 7, wherein each fluke is pivotally attached to the grapnel towards the rear thereof, and wherein each fluke is also secured to the grapnel by a shear means forward of the pivot whereby overloading of the fluke ruptures the shear means, permitting release of the grapnel by the pivoting of the fluke.

9. A grapnel according to claim 1, wherein the rotor includes shear means adapted for release at a predetermined tension, whereby overloading of the grapnel releases the clutch to permit unwinding of the rotor to release any held cable.

10. A grapnel for recovering cables from the sea bed by towing the grapnel along the sea bed, said grapnel comprising:

a rotor cable of acquiring and winding a portion of an encountered cable thereon, said rotor being presettable prior to a recovery operation to rotate either clockwise or counter-clockwise upon encountering a cable to be recovered; and a cable cutting station disposed on each of two opposite sides of said rotor at positions where one said cutting station will engage and cut an acquired cable when the rotor is set for clockwise rotation and the other of said cutting stations will engage and cut an acquired cable when the rotor is set for counter-clockwise rotation.

* * * * *